US005884804A

United States Patent [19]

King

[11] Patent Number: 5,884,804

[45] Date of Patent: Mar. 23, 1999

[54] FOLDED SHEET DISPENSER

[75] Inventor: Timothy James King, Clwyd, Wales

[73] Assignee: Kimberly-Clark Corporation, Neenah, Wis.

[21] Appl. No.: 650,725

[22] Filed: May 20, 1996

[51] Int. Cl.[6] ..... A47K 10/24

[52] U.S. Cl. ..... 221/45; 221/48

[58] Field of Search ..... 221/33, 45, 48, 221/63, 282, 303, 307; 206/449, 812

[56] References Cited

U.S. PATENT DOCUMENTS

| | | | |
|---|---|---|---|
| 1,577,094 | 3/1926 | Arms | 221/48 |
| 1,588,733 | 6/1926 | Hoberg | 221/45 |
| 1,724,428 | 8/1929 | Sherman | 221/46 |
| 2,000,454 | 5/1935 | Peters | 221/45 |
| 2,529,853 | 11/1950 | Taggart | 206/57 |
| 2,656,916 | 10/1953 | Henderson | 206/57 |
| 2,730,267 | 1/1956 | Marcalus | 221/48 |
| 2,765,909 | 10/1956 | Graham | 206/57 |
| 2,840,266 | 6/1958 | Nelson | 221/48 |
| 2,840,267 | 6/1958 | Nelson | 221/48 |
| 2,927,714 | 3/1960 | Nelson | 221/48 |
| 3,036,729 | 5/1962 | Asman | 221/48 |
| 3,095,996 | 7/1963 | Babin | 221/52 |
| 3,144,961 | 8/1964 | Phenner | 221/48 |
| 3,178,054 | 4/1965 | Lindecker | 221/48 |
| 3,207,361 | 9/1965 | Marcalus | 221/48 |
| 3,224,632 | 12/1965 | Marcalus | 221/48 |
| 3,239,097 | 3/1966 | Bates et al. | 221/48 |
| 3,266,666 | 8/1966 | Nelson | 221/48 |
| 3,369,698 | 2/1968 | Scholz | 221/48 |
| 3,490,645 | 1/1970 | Glass et al. | 221/48 |
| 3,606,082 | 9/1971 | Kuchenbecker | 221/52 |
| 3,780,908 | 12/1973 | Fitzpatrick et al. | 221/48 |
| 3,819,043 | 6/1974 | Harrison | 206/449 |
| 4,512,478 | 4/1985 | Korte | 221/63 |
| 4,623,074 | 11/1986 | Kearwester | 221/48 |
| 4,678,099 | 7/1987 | Matsui | 221/48 |
| 4,768,679 | 9/1988 | Matsui | 221/48 |
| 5,219,421 | 6/1993 | Tipping | 221/63 |

FOREIGN PATENT DOCUMENTS

| | | | |
|---|---|---|---|
| 618285 | 4/1961 | Canada | 221/48 |
| 893001 | 2/1972 | Canada | 221/48 |
| 1151121 | 8/1983 | Canada | 221/48 |
| 0331027A1 | 9/1989 | European Pat. Off. . | |
| 0444444A1 | 9/1991 | European Pat. Off. | 221/48 |
| 3127358A1 | 1/1983 | Germany . | |
| 8708274 | 9/1987 | Germany | 221/48 |
| 1002215 | 8/1965 | United Kingdom | 206/57 |
| 1112680 | 5/1968 | United Kingdom | 221/48 |
| 1443111 | 7/1976 | United Kingdom | 221/50 |
| 1476303 | 6/1977 | United Kingdom | 221/48 |
| 8912418 | 12/1989 | WIPO . | |

*Primary Examiner*—Kenneth Noland
*Attorney, Agent, or Firm*—K. V. Sidor

[57] ABSTRACT

A dispenser for individually dispensing sheets of material from a column of sheets of material formed by a plurality of vertically stacked, folded sheets of material is provided. The dispenser is sized for receiving a plurality of vertically stacked, folded sheets of material and includes a bottom surface, a forward wall, a rear wall. The forward wall and the rear wall are separated by spaced-apart side walls. The bottom surface defines a discharge opening having a length dimension greater than a width dimension. The discharge opening is orientated such that the length dimension is generally in a transverse orientation with respect to the orientation of the forward wall. The plurality of vertically stacked, folded sheets of material within the housing are supported by the bottom surface. Each sheet includes a leading edge and a trailing edge separated by spaced-apart side edges. In the process of dispensing individual sheets from the dispenser, the side edges of the sheets are urged inwardly by the width dimension of the discharge opening as individual sheets pass through the opening.

6 Claims, 4 Drawing Sheets

FOLDED SHEET DISPENSER

FIELD OF THE INVENTION

The present invention is directed to folded sheet dispensers. Particularly, the present invention is directed to bottom discharge sheet dispensers for dispensing folded tissue sheets, paper towels sheets or the like. More particularly, the present invention is directed to bottom discharge sheet dispensers for dispensing interleaved bath tissue sheets.

SUMMARY OF THE INVENTION

The present invention provides a dispenser having a bottom surface defining an opening, such as a discharge opening. The opening has a length dimension which is greater than the opening's width dimension. The opening is adapted such that web material, such as a sheet of tissue or paper towel, passing through the opening is narrowed by the width dimension of the opening.

In one embodiment, the dispenser may include a forward wall and a rear wall connected by spaced-apart side walls. The rear wall may be adapted for securing the dispenser to a support. In this embodiment, the length dimension of the opening may generally be in a transverse orientation with respect to the orientation of the forward wall and desirably, the length dimension of the opening may be generally perpendicular to the forward wall. Generally, the shape of the opening may be characterized as rod-shaped, oval, star, dumbbell, clover, elliptical, keyhole-shaped, and/or oblong. The shape of the opening may be characterized by other shapes so long as the width dimension is configured to narrow a sheet of material passing therethrough.

The material dispensed by the dispenser may be a plurality of vertically stacked, folded sheets. Each sheet may include a leading edge and a trailing edge spaced-apart by side edges connected to the leading and trailing edges. During the process of dispensing such material, and particularly such folded sheets from the dispenser, the side edges of the folded sheets are urged inwardly towards each other, or are converged by the width dimension of the discharge opening as said sheets pass through the discharge opening. In this way, it may be said that the sheets are "narrowed" by the width dimension of the discharge opening as the sheets pass through or traverse the discharge opening.

In another embodiment of the present invention, a dispenser for dispensing individual sheets from a plurality of vertically stacked, folded sheets is provided. The dispenser includes a housing sized for receiving a plurality of vertically stacked, folded sheets. The housing includes a bottom surface, a vertically oriented forward wall and a vertically orientated rear wall separated by spaced-apart vertically orientated side walls which are connected to the bottom surface, the forward wall and the rear wall. The bottom surface defines a sheet discharge opening having a length dimension greater than its width dimension. The length dimension is generally in a transverse orientation with respect to the orientation of the forward wall. A plurality of vertically stacked, folded sheets and desirably, a plurality of vertically stacked interleaved sheets, are provided within the housing and supported by the bottom surface. Each sheet includes a leading edge and a trailing edge separated by spaced-apart side edges. The side edges of each sheet are urged inwardly by the width dimension of the discharge opening as the sheets are discharged from the dispenser through the discharge opening. Generally, the shape of the discharge opening may be characterized as rod-shaped, oval, star, dumbbell, clover, elliptical, keyhole-shaped and/or oblong.

DETAILED DESCRIPTION OF THE INVENTION

Figure 1:
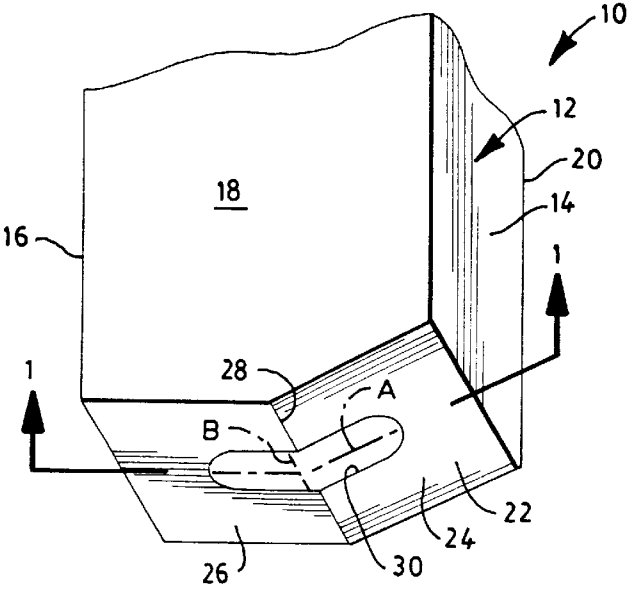
FIG. 1 is a perspective view of a dispenser with certain portions cut away.

Referring now to FIG. 1, a bottom discharge tissue or paper towel dispenser 10 is illustrated. The dispenser 10 includes a housing 12 sized for receiving a dispensable material, and desirably a plurality of folded sheets and more desirably a plurality of vertically stacked, interleaved sheets (see FIGS. 4A and 4B).

The housing 12 includes a forward wall 14, a rear wall 16 and two side walls 18 and 20. Desirably, the forward wall 14 and the rear wall 16 are vertically orientated and are separated by the spaced-apart vertically orientated side walls 18 and 20. The rear wall 16 is desirably configured to be secured to a support surface (FIGS. 4A and 4B), such as a wall, in a conventional manner, such as by bolting, gluing, nailing, brackets, screwing, etc. In this way, the forward wall 14 of the dispenser 10 is nearest an individual (not shown) in facing relationship to the forward wall 14.

In one embodiment, the housing 12 further includes a bottom surface 22. Desirably, the bottom surface 22 is "by-planar". That is, the bottom surface 22 is formed by two surfaces, 24 and 26, which intersect along an edge 28 at an angle which is either greater than or less than 180°. The surfaces 24 and 26 may be planar or curvilinear.

The bottom surface 22 further includes portions defining a discharge opening 30. The discharge opening 30 has a length dimension, illustrated by broken line A, and a width dimension B, illustrated by broken line B. The width dimension B is generally in a parallel orientation with respect to the orientation of either the rear wall 16 or the forward wall 14 and generally in a transverse or perpendicular orientation with respect to the orientation of one of the side walls, 18 or 20. The length dimension A is generally in a transverse or perpendicular orientation with respect to the orientation of either the rear wall 16 or the forward wall 14 and generally in parallel orientation with respect to the orientation of one or both of the side walls, 18 or 20. This orientation of the opening 30 with respect to the bottom surface 22 may also be referred to as "front-to-back", i.e., wherein the length dimension A, longer of the two dimensions, A and B, is oriented in a direction from the forward wall 14 to the rear wall 16.

Figure 1A:
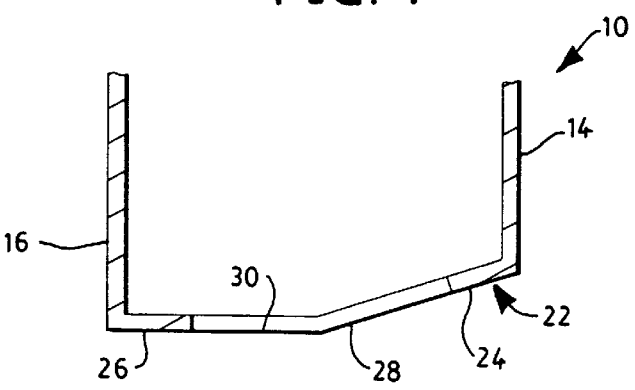
FIG. 1A is a cross-sectional view of FIG. 1 through lines 1—1

FIG. 1A is a portion of the dispenser 10 in cross section and more clearly illustrates the position of opening 30 with respect to the bottom surface 22, and particularly with respect to the surfaces 24 and 26.

Figure 2:
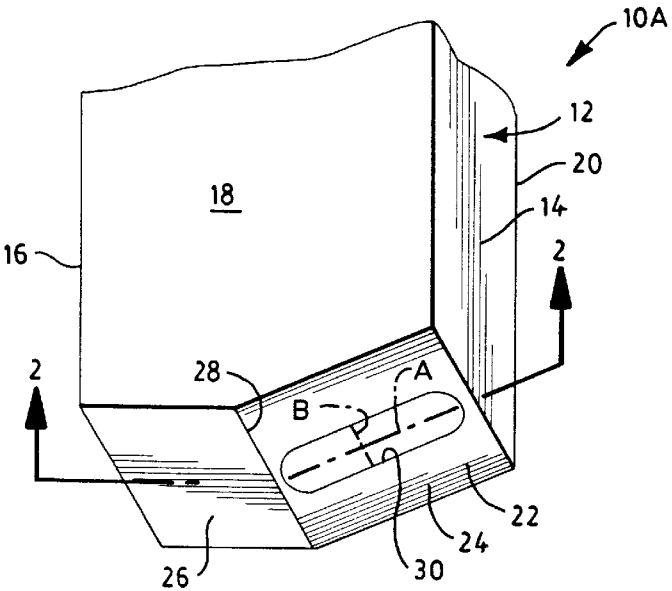
FIG. 2 is a perspective view of another embodiment of a dispenser.

FIG. 2 illustrates a dispenser 10A which is substantially similar to the dispenser 10, except that the opening 30 is defined solely by the dimension of the surface 24 of the bottom surface 22.

Figure 2A:
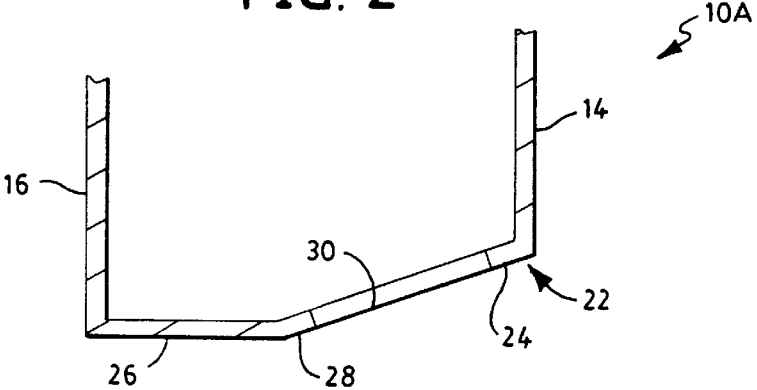
FIG. 2A is a cross sectional view of FIG. 2 through lines 2—2.

FIG. 2A is a portion of the dispenser 10A in cross section and more clearly illustrates the position of opening 30 with respect to the bottom surface 22 and particularly with respect to the surfaces 24 and 26.

FIGS. 3A–E illustrate several examples of the shape of the discharge opening 30. The respective length dimensions of each shape in FIGS. 3A–E are illustrated by broken line A. The respective width dimensions of each shape in FIGS. 3A–E are illustrated by broken line B.

Figure 3A:
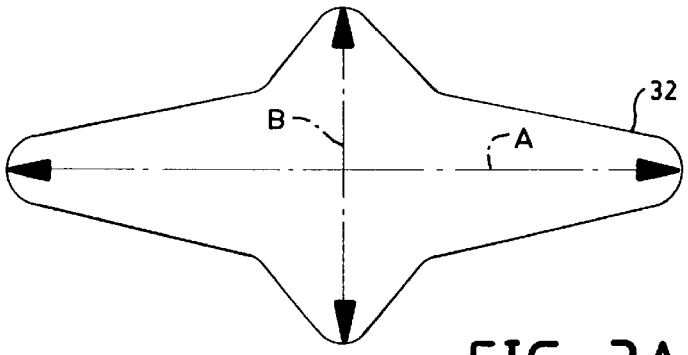
FIGS. 3A–E illustrate various discharge opening shapes.
Figure 3B:
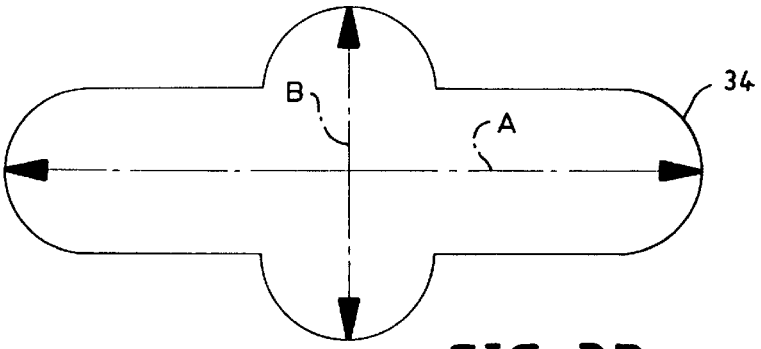
Figure 3C:
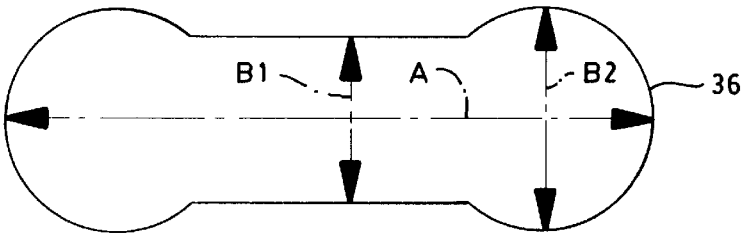
Figure 3D:
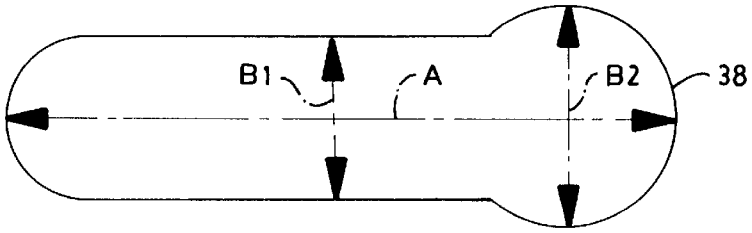
Figure 3E:
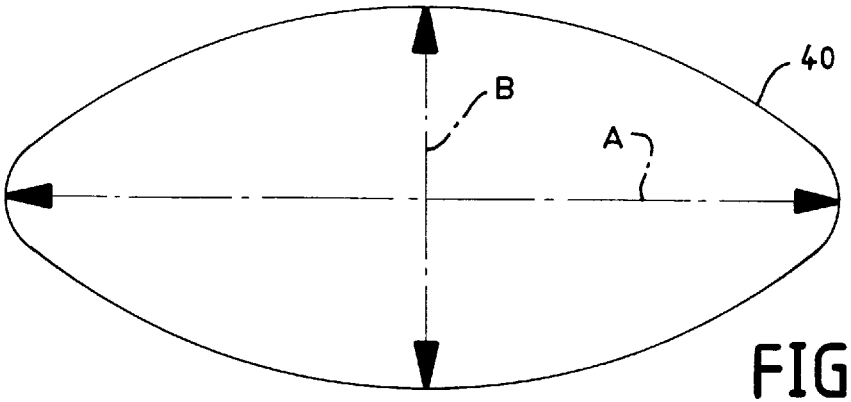

In some instances, for example in FIGS. 3C and 3D, broken line B1 and B2 illustrate separate width dimensions of varying size within each of the respective shapes. However, in these instances, the length dimension A remains greater than the larger of either width dimension B1 or B2.

The shape of the discharge opening 30 illustrated in FIGS. 1 and 2 may be characterized as "rod-shaped". Referring now to FIG. 3A, shape 32 may be characterized as "star-shaped". Shape 34 of the discharge opening 30 illustrated in FIG. 3B may be characterized as "clover-shaped". Shape 36 of the discharge opening 30 illustrated in FIG. 3C may be characterized as "dumbbell-shaped". Shape 38 of the discharge opening 30 illustrated in FIG. 3D may be characterized as "keyhole-shaped". Shape 40 of the discharge opening 30 illustrated in FIG. 3E may be characterized as "oval-shaped".

Figure 4B:
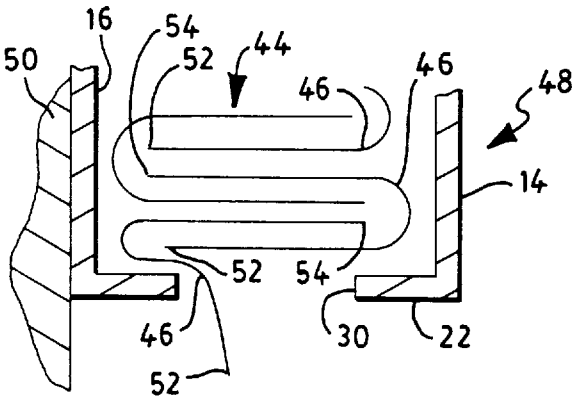
FIGS. 4A–B is a schematic cross section of a dispenser illustrating a dispensing sequence for a plurality of vertically stacked, interleaved sheets.
Figure 4A:
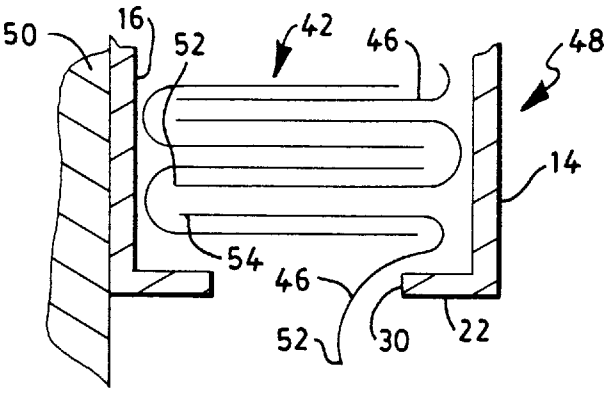

Referring now to FIGS. 4A and 4B, two columns 42 and 44, each containing a plurality of vertically stacked folded sheets 46 and particularly a plurality of vertically stacked interleaved sheets, are illustrated. More particularly, within each column 42 and 44, each sheet 46 is generally folded in half upon itself such that the folded halves capture the trailing edge 54 of the sheet directly below it and the leading edge 52 of the sheet directly above it. Each column, 42 and 44, is supported within a dispenser 48 by the bottom surface 22. The dispenser 48 is similar to the dispensers 10 and 10A. For purposes of describing the folded sheet 46, only the forward wall 14, the rear wall 16, the bottom surface 22 and the discharge opening 30 of the dispenser 48 are illustrated. As previously mentioned, the dispenser 48 may be secured to a support surface 50, such as a wall, by securely attaching the rear wall 16 to the support surface 50.

The interleaved folding pattern illustrated in FIGS. 4A and 4B result in a "front-to-back" sheet dispensing sequence. In other words, referring to FIG. 4A, the portion of the sheet 46 extending through the opening 30 is nearer the forward wall 14 than the rear wall 16. As such, the sheet 46 in FIG. 4A is in the "front" stage of the front-to-back sequence. As the remaining portion of the sheet 46 extending through the opening 30 of the dispenser 48 (FIG. 4A) is removed, the leading edge 52 of the next sheet 46 extends through the opening 30 (FIG.4B). The portion of this sheet 46 extending through the opening 30 in FIG.4B is nearer the rearer wall 16 than the forward wall 14. As such, the sheet 46 in FIG.4B is in the "back" stage of the front-to-back sequence.

Figure 5:
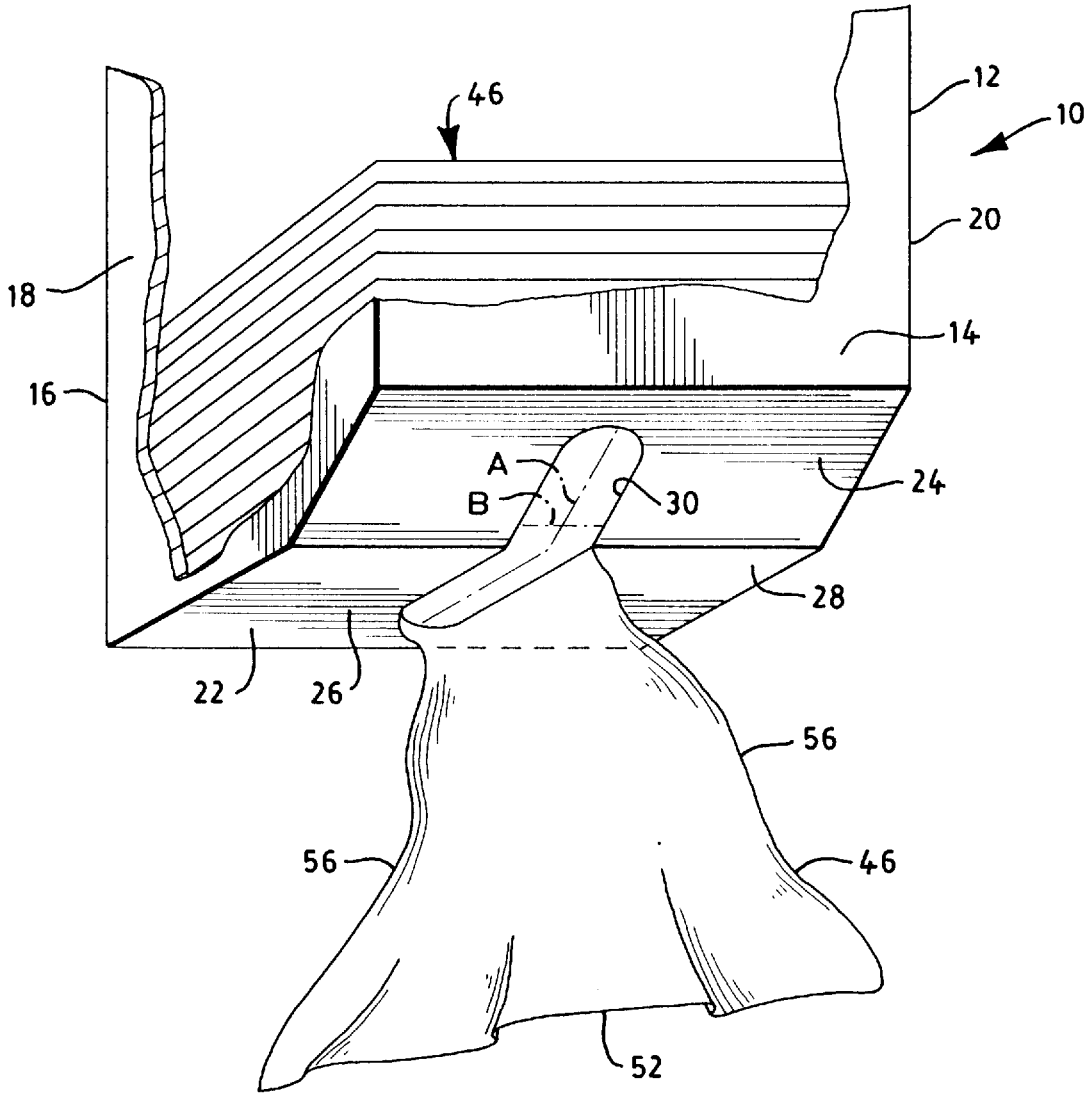
FIG. 5, is a fragmented, enlarged, perspective view of the dispenser of FIG. 1 illustrating the dispenser in use with a plurality of vertically stacked sheets supported within the dispenser.

Referring now to FIG.5, the dispenser 10 is illustrated in dispensing operation. Portions of the side wall 18 and forward wall 14 are removed so that the column 42 containing the plurality of vertically stacked, folded sheets 46 positioned within the housing 12 of dispenser 10 may be illustrated. The plurality of vertically stacked, folded sheets 46 are supported by the bottom surface 22.

As previously described, the length dimension, illustrated by broken line A, of the discharge opening 30 is greater than the width dimension illustrated by broken line B. The orientation of the discharge opening 30 may be described by reference to the orientation of the length and/or width dimension thereof with respect to either the forward and/or rear walls, 14 and 16, respectively and/or the side walls 18 and/or 20. For example, as illustrated in FIG. 5, the length dimension A is generally in a transverse orientation, and desirably in a perpendicular orientation, with respect to the orientation of either the forward wall 14 or the rear wall 16 and generally in a parallel orientation with respect to the orientation of either side wall, 18 or 20. Another description of the orientation of the opening 30, for example, would be the width dimension B is generally in a transverse orientation, and desirably in a perpendicular orientation, with respect to the orientation of either side wall, 18 and/or 20 and is generally in a parallel orientation with respect to the orientation of either the forward wall 14 and/or the rear wall 16.

FIG. 5 further illustrates a portion of one of the sheets 46 extending through the discharge opening 30. More particularly, the leading edge 52 of the sheet 46 extends below the opening 30 and a portion of each side edge 56 extends below the opening 30. In the process of dispensing sheets 46 from the dispenser 10, the side edges 56 of the sheets 46 are urged inwardly towards each other or are converged by the width dimension B of the opening 30 as said sheets pass through the opening 30. In this way, it may be said that the sheets 46 are "narrowed" by the width dimension B of the opening 30 as the sheets 46 pass through or traverse the opening 30. According to the invention, it is desirable that the stack of folded sheets 46 are configured such that the leading edges 52 extend across the opening 30 parallel to the width dimension B (i.e., perpendicular to the length dimension A).

While the invention has been described in detail with respect to specific embodiments thereof, it will be appreciated that those skilled in the art, upon attaining an understanding of the foregoing, may readily conceive of alterations to, variations of and equivalents to these embodiments.

What is claimed is:

1. A dispenser for dispensing a plurality of vertically stacked, folded sheets comprising:

a plurality of vertically stacked, folded sheets, each sheet including a leading edge and a trailing edge and spaced-apart side edges; and a housing adapted for securing to a support and having a bottom defining an opening having a length dimension greater than a width dimension wherein said bottom includes a nonplanar surface, said housing receiving said plurality of sheets so that said side edges are urged inwardly by said width dimension of said opening as said sheets pass through said opening.

2. The dispenser of claim 1 wherein said non-planar surface includes a first section and a second section, said first section and said section each having a first edge and a second edge and being attached to each other at said first edges between and below said second edges, wherein said first edges and said second edges are generally parallel to said width dimension of said opening, and wherein said first section at least partially defines said opening.

3. The dispenser as in claim 2, wherein each of said first section and said second section is generally planar.

4. The dispenser as in claim 2 wherein said opening is defined by said first section and said second section.

5. The dispenser as in claim 1, further including a forward wall and a rear wall connected by spaced-apart side walls, wherein the length dimension of the opening is generally in a transverse orientation with respect to the orientation of the forward wall.

6. The dispenser as in claim 1 wherein said bottom includes a first section and a second section, said first section and said second section each having a first edge and a second edge and being attached to each other at said first edges between and below said second edges, wherein said first edges and said second edges are generally parallel to said width dimension of said opening, and wherein said first section at least partially defines said opening.

* * * * *